US011388507B2

(12) United States Patent
Liu

(10) Patent No.: US 11,388,507 B2
(45) Date of Patent: Jul. 12, 2022

(54) METHOD AND SYSTEM FOR OPERATING WEARABLE SOUND SYSTEM

(71) Applicant: Invictumtech Inc., Diamond Bar, CA (US)

(72) Inventor: Stan Shih Tai Liu, Diamond Bar, CA (US)

( * ) Notice: Subject to any disclaimer, the term of this patent is extended or adjusted under 35 U.S.C. 154(b) by 402 days.

(21) Appl. No.: 16/523,943

(22) Filed: Jul. 26, 2019

(65) Prior Publication Data

US 2021/0029443 A1 Jan. 28, 2021

(51) Int. Cl.

*H04R 1/10* (2006.01)
*H04R 29/00* (2006.01)
*H04R 1/40* (2006.01)

(52) U.S. Cl.

CPC ..... *H04R 1/1075* (2013.01); *H04R 1/105* (2013.01); *H04R 1/1008* (2013.01); *H04R 1/1083* (2013.01); *H04R 1/406* (2013.01); *H04R 29/005* (2013.01); *H04R 2201/401* (2013.01); *H04R 2410/07* (2013.01)

(58) Field of Classification Search

CPC .... H04R 1/1008; H04R 1/105; H04R 1/1075; H04R 1/1083; H04R 1/406; H04R 29/005; H04R 2201/025; H04R 2201/107; H04R 2201/109; H04R 2201/401; H04R 2410/07

See application file for complete search history.

(56) References Cited

U.S. PATENT DOCUMENTS

| | | | | |
|---|---|---|---|---|
| 4,875,233 | A * | 10/1989 | Derhaag | H04M 1/05 379/430 |
| 5,729,615 | A | 3/1998 | Yang | |
| 5,761,298 | A * | 6/1998 | Davis | H04M 1/05 379/430 |
| 5,970,155 | A * | 10/1999 | Leppalahti | H04R 1/1058 379/430 |
| 8,243,943 | B2 * | 8/2012 | Nordin | H04R 1/1083 381/72 |
| 9,813,799 | B2 * | 11/2017 | Gecawicz | H04R 1/1008 |
| 2005/0105740 | A1 * | 5/2005 | Dyer | H04M 1/6091 381/16 |

FOREIGN PATENT DOCUMENTS

| | | |
|---|---|---|
| CN | 102037736 B | 2/2015 |
| CN | 105812976 B | 5/2017 |
| CN | 207612422 U | 7/2018 |
| TW | M464955 | 11/2013 |

* cited by examiner

*Primary Examiner* — Huyen D Le

(57) ABSTRACT

A wearable sound system includes a microphone on a movable outer part of an earpiece to convert sound from acoustic input signals to audio input signals; a processing unit to process the audio input signals to generate audio output signals; a speaker on the earpiece to convert the audio output signals to acoustic output signals, wherein the outer part of the earpiece with the microphone is rotatable, wherein the outer part of the earpiece with the microphone is pivotable or laterally extensible and retractable to obtain an optimal audio input signal, and to minimize ambient noise and interference.

20 Claims, 17 Drawing Sheets

METHOD AND SYSTEM FOR OPERATING WEARABLE SOUND SYSTEM

FIELD OF THE INVENTION

The present invention generally relates to a multi-directional wearable sound system. More so, the present invention relates to a speaker and/or microphone sound system that provides multiple speakers arranged in a rotatable configuration on at least one earpiece, with each speaker providing a range of sound frequencies, and the speakers being rotatable to cover the ear canal for selectively listening to desired sound phase; and further comprises a microphone array arranged in a rotatable configuration on the at least one earpiece, with the microphone array being rotatably, pivotally, or laterally adjustable along an azimuth plane or an elevation plane to selectively optimize sound reception and minimize ambient noise interference.

BACKGROUND OF THE INVENTION

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

Typically, sound receiving and delivering wearable devices are operable to position and stabilize audio transducers to convert useful acoustic input or output to audio signals to the ears. Such specialized input and output acoustic transducers are conventionally called microphones or speakers, respectively. These wearable sound devices allows for efficient transmission of audio signals and sounds to the ears. Often, such sound systems include headsets, which allow two-way communications; or headphones, which are used for listening to music and other audible waveforms. These sound systems are scalable to accommodate different variations of sound, and different head sizes when fitted on the head.

In many instances, hands-free communication is desirable for telephone communication because a user can operate the mobile telephone to speak or listen without requiring the use of the hands. Furthermore, hands-free communication is attractive because it frees up the hands by not requiring the hands to hold the telephone in a position such that the speaker and microphone of the telephone are located near the ear and mouth during a telephone conversation. Moreover, it has been very challenging for having hands-free communication over the phone in a noisy environment. Such a hostile usage scenario enables the demand for a directional or movable microphone to provide better sound source reception by pointing to or being closer to the mouth when talking in the phone conversation.

Other than providing communications or recreation for normal people, some of the aforementioned wearable devices can also assist people with difficulty in listening, also known as hearing impaired (HI), to improve their quality of life by amplifying desired sounds around their living environment and reducing unpleasant noise. Such hearing assistive devices are called hearing aids (HA), and it has been widely available for years. Modern new technology opens more opportunities to help HI people by encapsulating more advanced digital signal processing (DSP) functions into a tiny wearable sound device during the last decade. Due to the size limitation of its form factor, however, those HA's are neither adjustable nor flexible to change the locations of the microphones on devices. HI users have to move around their heads or bodies quickly to have better sound receptions, and it is even worse when those users are involved in the group discussions. Having configurable HA with moving microphones, therefore, can possibly reduce users' movements and ease the anxiety of losing contents during discussions. Besides, conventional speakers are manufactured by using specific materials to generate a designated range of audible sound frequencies. In multi-speaker audio systems, each speaker is designed to produce different ranges of sound frequencies to have an overall pleasant sound to listeners. Fixed-mounted configurations with either single or multiple speakers appear in current design for all wearable audio devices available for consumers on the market, such as headphones or headsets. It provides no flexibility for listeners to change the configurations of the speakers on the headphones or headsets while being worn on the head of the listener.

Even though prior proposals involved directional microphones and adjustable speaker sound systems may meet some of the needs of the market, a multi-directional wearable speaker and microphone sound system that provides multiple speakers arranged in a rotatable configuration on at least one earpiece, with each speaker providing a range of different frequencies, and the speakers being rotatable with respect to an ear canal for selectively listening to the desired sound phase; and further comprises a microphone array arranged in a rotatable configuration on the at least one earpiece, with the microphone array being rotatably, pivotally, or laterally adjustable along an azimuth plane or an elevation plane to selectively optimize sound reception and minimize ambient noise interference, is still desired to achieve individually preferred listening experience.

SUMMARY

Illustrative embodiments of the disclosure are generally directed to a multi-directional wearable speaker and microphone sound system. The speaker and microphone sound systems serve to enhance a listening experience through the use of a wearable earpiece or headphone assembly that includes both, multiple speakers and a microphone array. The earpiece provides an audio signal to the first and second ears of a listener.

The speakers are operable with the earpiece and configured to rotate along an azimuth plane with the earpiece. Each speaker is operable to generate a range of sound frequencies. The speakers are manually or automatically rotatable to be positioned to cover the outer opening of an ear canal for selectively listening to desired sound phases. This is achieved by using the principle that the phase of higher audible frequencies can be changed more significantly if the speakers producing higher sound frequencies are placed on the outer circle of the earpiece, while speakers producing lower sound frequencies are placed on the inner circle of the earpiece and therefore have relatively non-significant phase change during rotation.

The microphone array is operable with the earpiece to transduce a captured audio signal. The microphone array is rotatably, pivotally, or laterally adjustable along an azimuth plane or an elevation plane to selectively optimize desired sound reception and minimize ambient noise interference. The listener can adjustably orient the microphone array to the direction of the listener's desired external sound source to obtain an optimal audio signal and minimal noise interference In a general implementation, a method for operating a wearable sound system on an earpiece, the method comprising: rotating at least one speaker along directions of ears of listeners; rotating at least one microphone along the azimuth plane towards directions of audio signals from a sound source; pivoting the microphones along an elevational plane towards directions of the audio signals, or laterally extending and retracting the microphones towards directions of the audio signals.

In another aspect combinable with the general implementation, the method further comprises a step of detecting a direction of the speaker to determine the speaker's preferred direction for the listener.

In another aspect combinable with the general implementation, the method further comprises a step of a response when the speaker is electrically connecting a signal receiver through a switch and through a speaker transducer to change an output of the speaker.

In another aspect combinable with the general implementation, at least one of the speakers can be a clockwise rotation or a counter-clockwise rotation.

In another aspect combinable with the general implementation, at least one of the speakers can be rotated along an angle from 0° to 360°.

In another aspect combinable with the general implementation, at least one of the earpieces can be rotated along with an angle from 0° to 360°.

In another aspect combinable with the general implementation, at least one of the microphones can be spacedly and isometrically arranged.

In another aspect combinable with the general implementation, at least one of the microphones can be arranged along a line.

In another aspect combinable with the general implementation, at least one of the speakers can be spacedly arranged in a radian.

Another aspect of the embodiment is directed to a wearable sound system, comprising: at least one earpiece; at least one speaker rotatably arranged on the earpiece; at least one microphone rotatably arranged along the azimuth plane towards directions of audio signals from a sound source; at least one microphone pivotable arranged along an elevational plane towards directions of the audio signals; wherein the microphones can laterally extend and retract towards directions of the audio signals.

Other systems, devices, methods, features, and advantages will be or become apparent to one with skill in the art upon examination of the following drawings and detailed description. It is intended that all such additional systems, methods, features, and advantages be included within this description, be within the scope of the present disclosure, and be protected by the accompanying claims and drawings.

BRIEF DESCRIPTION OF THE DRAWINGS

The invention will now be described, by way of example, with reference to the accompanying drawings, in which.

Like reference numerals refer to like parts throughout the various views of the drawings.

DETAILED DESCRIPTION OF THE INVENTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper," "lower," "left," "rear," "right," "front," "vertical," "horizontal," and derivatives thereof shall relate to the invention as oriented in FIG. 1. Furthermore, there is no intention to be bound by any expressed or implied theory presented in the preceding technical field, background, brief summary, or the following detailed description. It is also to be understood that the specific devices and processes illustrated in the attached drawings, and described in the following specification, are simply exemplary embodiments of the inventive concepts defined in the appended claims. Specific dimensions and other physical characteristics relating to the embodiments disclosed herein are therefore not to be considered as limiting unless the claims expressly state otherwise.

A multi-directional wearable speaker and microphone sound system 100 is referenced in FIGS. 1-20. The multi-directional wearable speaker and microphone sound system 100, hereafter "system 100", enhances audio input signals by rotating a microphone array 112 in the direction of the acoustic input signals and/or away from noise interference through rotational, pivotal, or lateral manipulation of the earpiece along an azimuth plane 502 and/or an elevational plane 802, and enhances audio output signals by rotating and then stopping multiple speakers 300*a-e* per individual's preference.

Figures 1, 2:
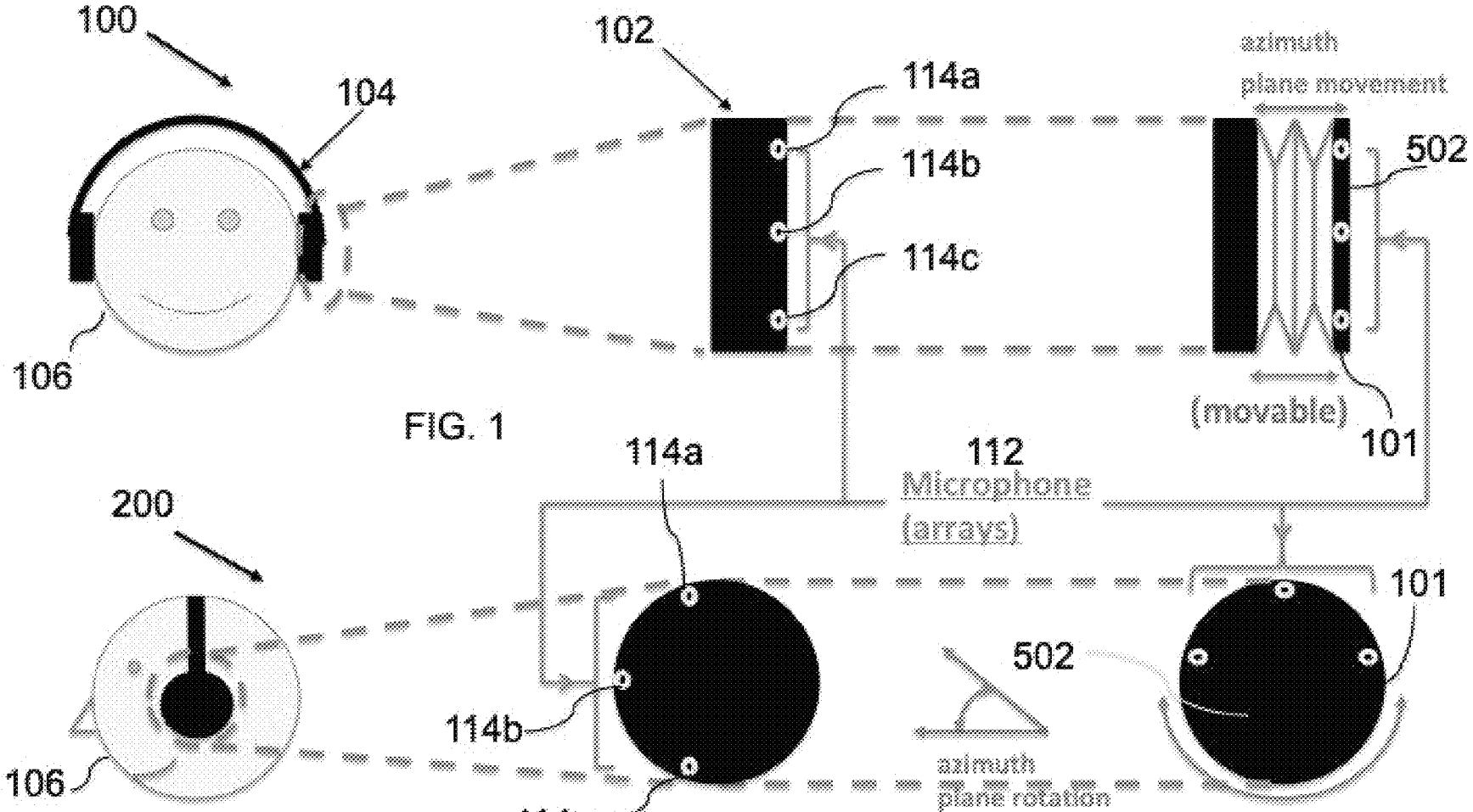
FIG. 1 illustrates a diagram view of an exemplary multi-directional wearable speaker and microphone sound system, showing the outer part of the earpiece extending and retracting along the azimuth plane of the microphones to position the microphones for the maximum sound reception, in accordance with an embodiment of the present invention.
FIG. 2 illustrates a diagram view of an exemplary multi-directional wearable speaker and microphone sound system, showing the outer part of the earpiece rotating along the azimuth plane to position the microphones for the maximum sound reception, in accordance with an embodiment of the present invention.

FIG. 1 illustrates a diagram view of an exemplary multi-directional wearable speaker and microphone sound system 100, showing the lateral movement of the outer part 101 of the earpiece 102 which is perpendicular to the azimuth plane 502, where the earpiece extends to position the microphones 114*a-c* for the optimal sound reception.

Figure 11:
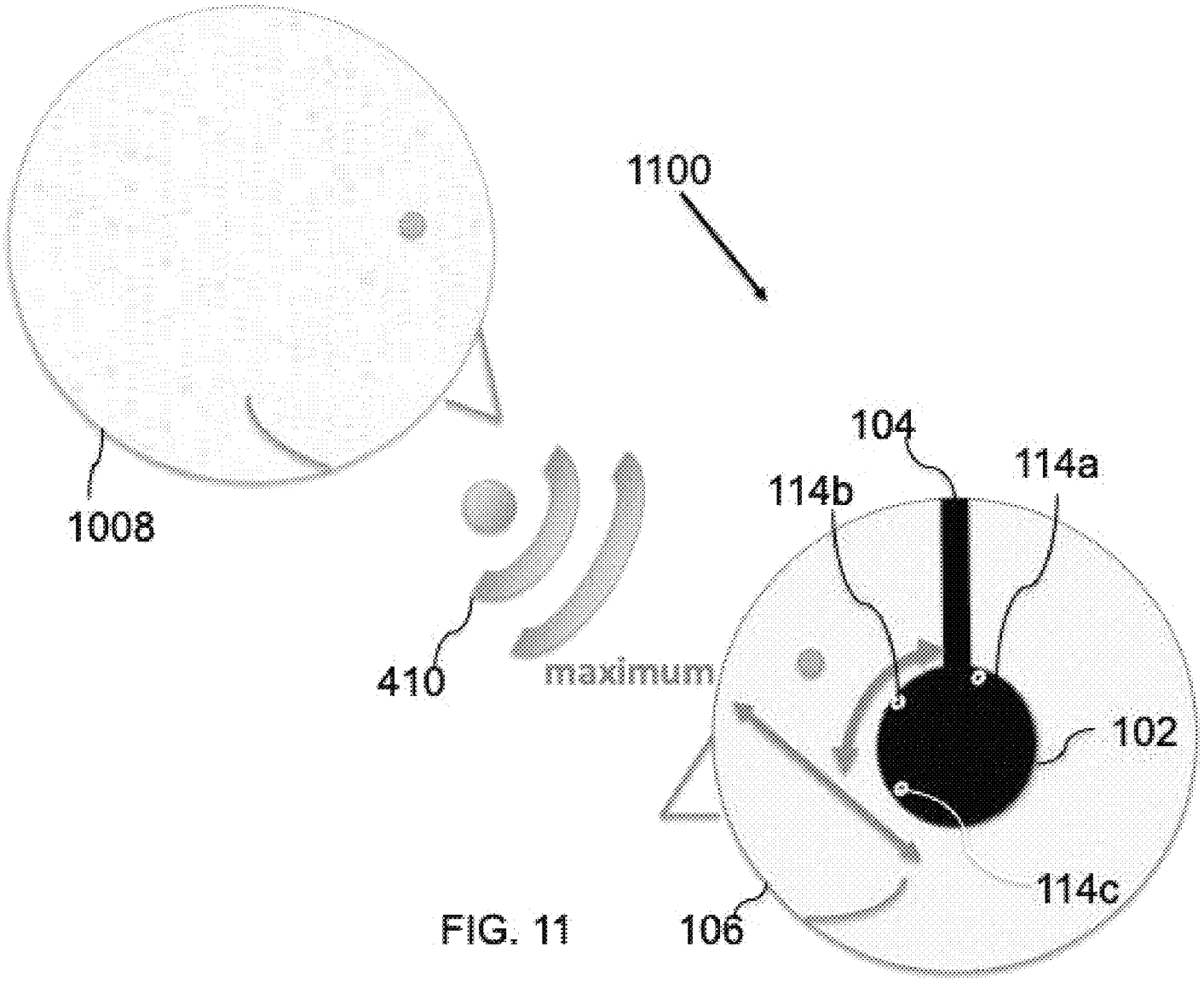
FIG. 11 illustrates a diagram showing a sound source emitting an audio signal at an optimal side angle towards the earpiece, in accordance with an embodiment of the present invention.

FIG. 2 illustrates rotational movement 200 of the earpiece 102 on the azimuth plane 502 to position the microphones 114*a-c* for the maximum sound reception. In one aspect, as shown in FIG. 11, the rotational movement 1100 the final stopping position of the microphones 114*a-c* may be used to determine the optimal or maximum sound.

In some embodiments, the system 100 may include at least one earpiece 102 that is configured to be wearable for providing an audio input signal 410 to the ears—either from an integral speaker or from external audio signals. In one non-limiting embodiment, the earpiece 102 is a headset speaker having a size-adjustable headband 104. The size-adjustable headband 104 can be increased or decreased in radius to accommodate variously sized heads. In this manner, the headset speaker snugly fits over the head of the listener 106 and is easily accessible by the hands to adjust the earpiece as needed. This allows the speakers 300*a-e* and microphone array 112 to be optimally positioned over the listener's ears.

It is significant to note that the terms "earpiece," "headset," and "headphone" are collectively referred to below as an "earpiece," in order to simplify the discussion that follows, but with the understanding that description applies to any wearable sound system known in the art. The earpiece may include an ear cushion or similar structure located adjacent to the listener's outer ear. The earpiece 102 may also include, without limitation, a headset having an adjustable microphone, a digital hearing aid, a wired metal earbud, a stereo phone, Walkman headphone, a Bluetooth headphone, a wireless earbud, an ear hook headphone, and a sports headphone and earbud.

The system 100 is unique in that the acoustic input signals are enhanced through easy, manual manipulation or automatic rotation of the earpiece while being worn. In one embodiment, the microphone array 112 on the outer part 101 of the earpiece 102 is manually or automatically operable to: rotate along an azimuth plane 502; pivot along an elevational plane 802; and extend and retract laterally along the azimuth plane 502 in relation to the earpiece. This adjustability allows the listener 106 to obtain the optimal reception of the directional audio signals 410.

Figure 3:
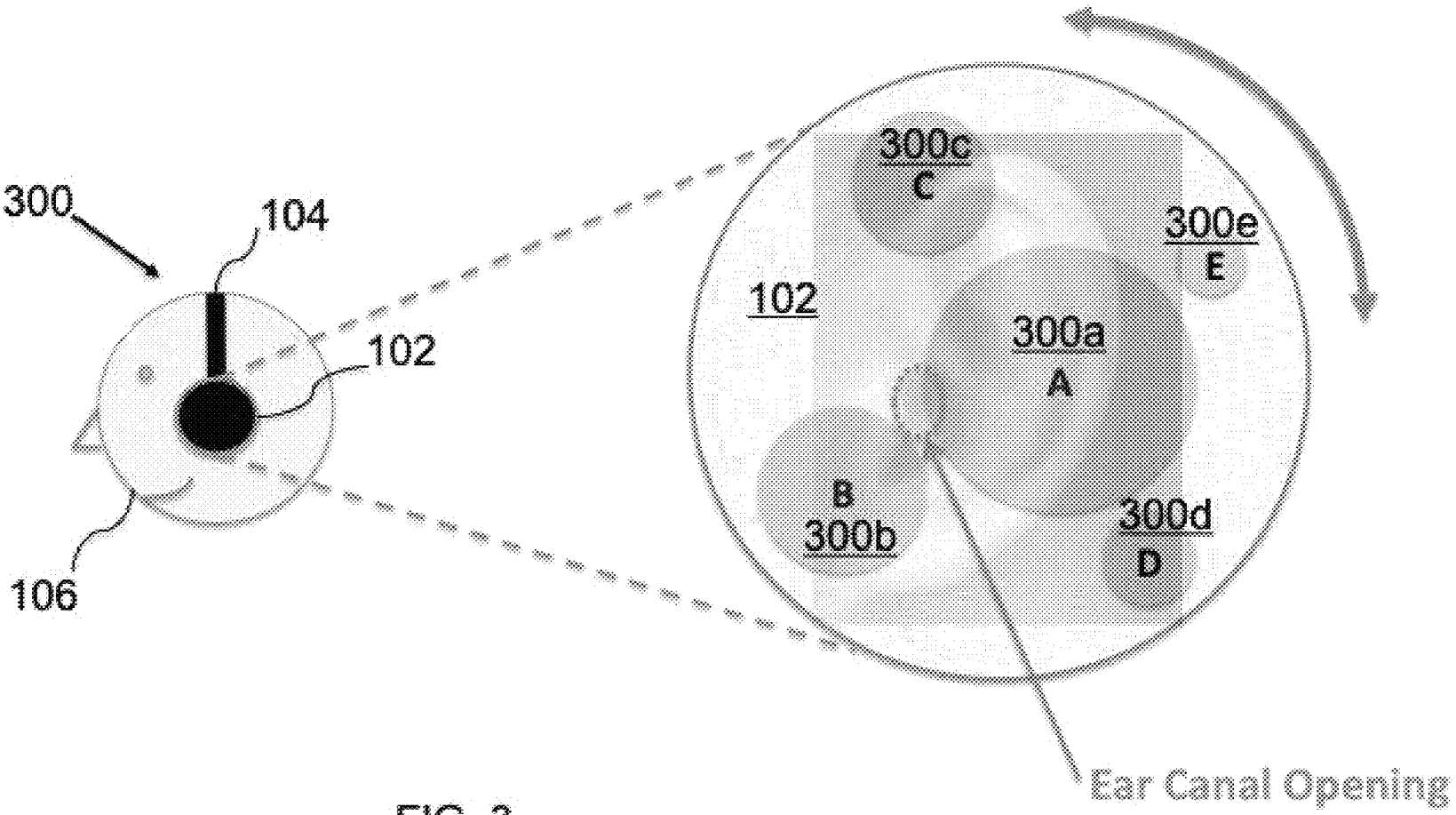
FIG. 3 illustrates a diagram view of multiple speakers having its own range of output sound frequencies being rotated for listening desired sound, in accordance with an embodiment of the present invention.

FIG. 3 illustrates a diagram view of multiple speakers 300*a-e* having multiple ranges of frequencies being rotated for optimal sound listening. The listener 106 can adjust for a specific frequency that matches a specific type of sound. For example, pop songs, concerts, and musicals may be preferred with enhanced lower frequencies; while some classical music, live broadcasting, or an animal wildlife documentary in which animal sounds are prevalent, may sound better with enhanced higher frequencies. With the help of equalizers, the rotatable speakers, therefore, can be adjusted in many different ways to accommodate more types of audio signals 410.

It is known in the art that a pitch of the sound is determined by a frequency measured as the number of wave cycles that occur in one second, and a phase of a sound wave is defined as a specific instant in time within a period of the wave. Thus, when a sound wave is generated from the vibrations of a sound source and travels a distance within the atmosphere on earth, different instants in time can be referred to different locations. Since the sound velocity is generally viewed as a constant through the air near the surface of the earth, a group of traveling sound waves consisting of different sound frequencies is equivalent to a group of traveling sound waves with different wavelengths and periods. This results in different phase combinations for different distances within a period of a sound frequency in the group of traveling sound waves. Given the commonly-known fact that a sound wave travels about 340 m per second in the air under a room temperature, and human average outer ear canal length is about 26 mm [1], any sound frequency above 3400 Hz travels from the outer opening of an ear canal to an eardrum inside the ear canal has significant phase change (~90°, or $\pi/2$), while sound frequencies below 1000 Hz have much fewer phase changes (<30°, or $\pi/6$) for the same traveling distance. Such phase changes may be audible by individuals [2]. Since most earpieces are designed in a circular shape, and human pinna anatomy is not symmetrical, so the outer opening of the ear canal mostly doesn't lie on the center of the circle after wearing circular earpieces shown in FIG. 3. This means if an earpiece is designed to be rotatable and high-frequency speakers are placed at the outer circle of the earpiece similar to the configuration in FIG. 3, the distance between high-frequency speakers on the earpiece and the eardrum inside the ear canal is different in each rotating position. Such a difference can, therefore, generate a unique phase combination for a given frequency range of the acoustic output signals.

In some embodiments, the earpiece 102 provides a plurality of speakers 300*a-e* that are operable, and integral, with the earpiece 102. In one possible embodiment, the speakers 300*a-e* are arranged in a rotatable configuration on the earpiece 102, with each speaker 300*a*, 300*b*, 300*c*, 300*d*, 300*e* being operable to generate a range of sound frequencies 302*a*, 302*b*, 302*c*, 302*d*, 302*e*. The speakers 300*a-e* are rotatable to selectively listen to at least one range of the sound frequencies. Such a rotatable capability for the speakers can alter the phases of the outgoing audio signals from the speakers 300*a-e* transmitted to an eardrum of an ear to have a personalized listening experience for the listener 106.

In one embodiment of the system 100 shown in FIG. 3, five speakers 300*a-e* having different ranges of frequencies are integrated into the earpiece 102. Speakers can be manually rotated directly by the listener, so as to provide the unique sound phase combinations for the listener preference.

For example, a first speaker 300*a* can output sound frequencies of less than 1 kilohertz 302*a*. The first speaker 300*a* may be the largest of the speakers, providing more low-frequency sound energy, emphasized by most pop songs music and the like. A second speaker 300*b* can output sound frequencies between 1 kilohertz and 2.5 kilohertz 302*b*.

Continuing with the different speakers that can be rotated around the ears, a third speaker 300*c* can output sound frequencies between 2.5 kilohertz and 5 kilohertz 302*c*. A fourth speaker 300*d* can output sound frequencies between 5 kilohertz and 8 kilohertz 302*d*. And a fifth speaker 300*e* can output sound frequencies greater than 8 kilohertz 302*e*. The fourth and fifth speakers 300*d-e* may be the smallest speakers.

Furthermore, when the speakers 300*a-e* are operable with Bluetooth, a television program or a video on a computer, a tablet, or a smartphone can provide the multi-channel audio with different sound frequencies as mentioned above.

Moreover, other than listening to different types of music, in yet another embodiment, the speakers 300*a-e* are operable to deliver multi-channel surround sound. The multi-channel surround sound includes at least three independent audio channels and speakers placed in front of and behind the ears on the earpiece 102. The purpose is to surround the listener 106 with the desired sound, frequencies, etc.

Referring to FIGS. 4-9, the earpiece 102 may also provide a microphone array 112 that is operable with the earpiece 102. The microphone array 112 may include one or multiple microphones positioned in such a way that the spatial acoustic information can be selectively captured. The audio signals are processed by the microphone array 112 based on wave propagation. As used in the present invention, the microphone array 112 can capture a sound signal from one point or several different points simultaneously for proper software processing, and create optimal spatial audio filtering [3]. This means that with a microphone array 112, the earpiece 102 can be oriented towards a point in space and filter out only the sound waves originating from that direction.

In yet another novel aspect of the present invention, the microphone array 112 is configured in a rotatable, pivotable, extendable, and retractable arrangement on the outer part 101 of the earpiece 102. This allows the microphone array 112 to capture the audio signal from one point or several different points simultaneously while transducing the captured audio signal.

In one embodiment, the microphone array 112 is rotatable along its azimuth plane 502 to obtain an optimal audio signal and to minimize noise interference, shown in FIG. 1. This motion involves twisting the microphone array 112 on the outer part 101 of the earpiece 102. This rotational manipulation can be used to adjust sound sources being listened to through the speakers, and also to directionally guide the microphones.

Figure 4:
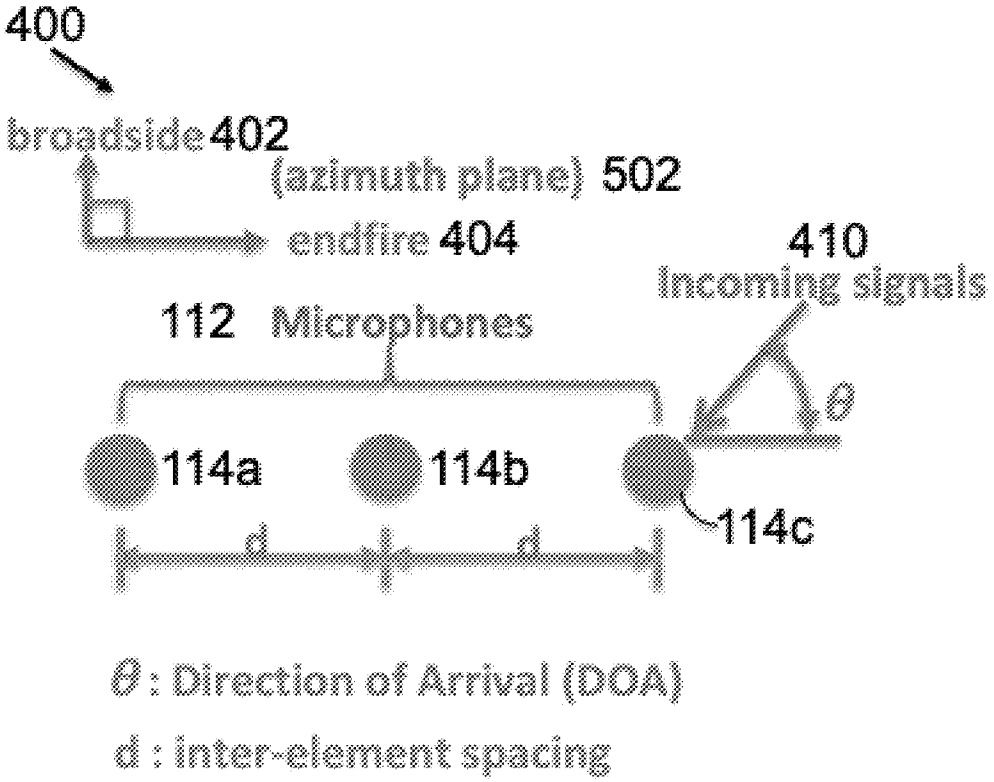
FIG. 4 illustrates the microphone array in a linear arrangement, showing the direction of the incoming audio signal, inter-element spacing, and the broadside and endfire direction for the array, in accordance with an embodiment of the present invention.
Figure 12:
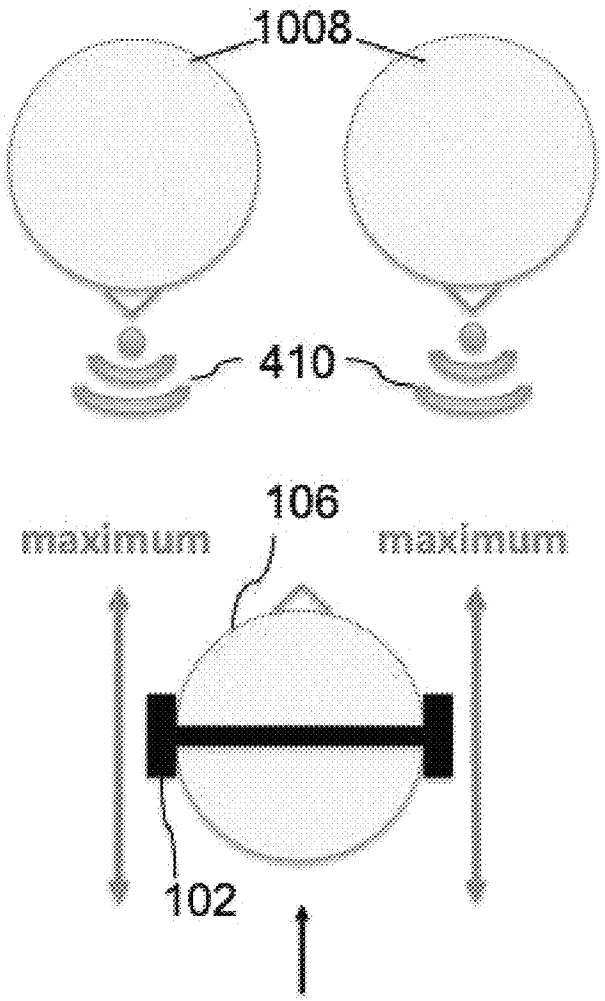
FIG. 12 illustrates the listener wearing two of the earpieces in a natural position to capture forward audio signals for the maximum sound reception, in accordance with an embodiment of the present invention.

FIG. 4 illustrates a microphone diagram showing the microphones 114*a-c* for a microphone array 112 configured in a linear arrangement 400. The linear arrangement 400 shows the incoming audio signals 410, a broadside direction 402 and an endfire direction 404 of the microphone array 112. The linear arrangement 400 also illustrates the incoming signals 410 is arriving the microphone array 112 on an azimuth plane 502 of the array 112, i.e., the desired sound source 1008, as shown in FIG. 12, and FIG. 13, is located at an upper, straight, or lower position with respect to the listener 106.

As referenced, the microphone array 112 comprises multiple microphones arranged in a linear configuration. For regular human speech sound, most energy is distributed below 5 KHz in frequency. For mid-high frequency human sound (1 KHz-5 KHz), the wavelength is ranging from 6 cm to 33 cm. ¼-wavelength inter-element spacing can, therefore, be one of the feasible configurations for headphone size array applications.

Figure 5:
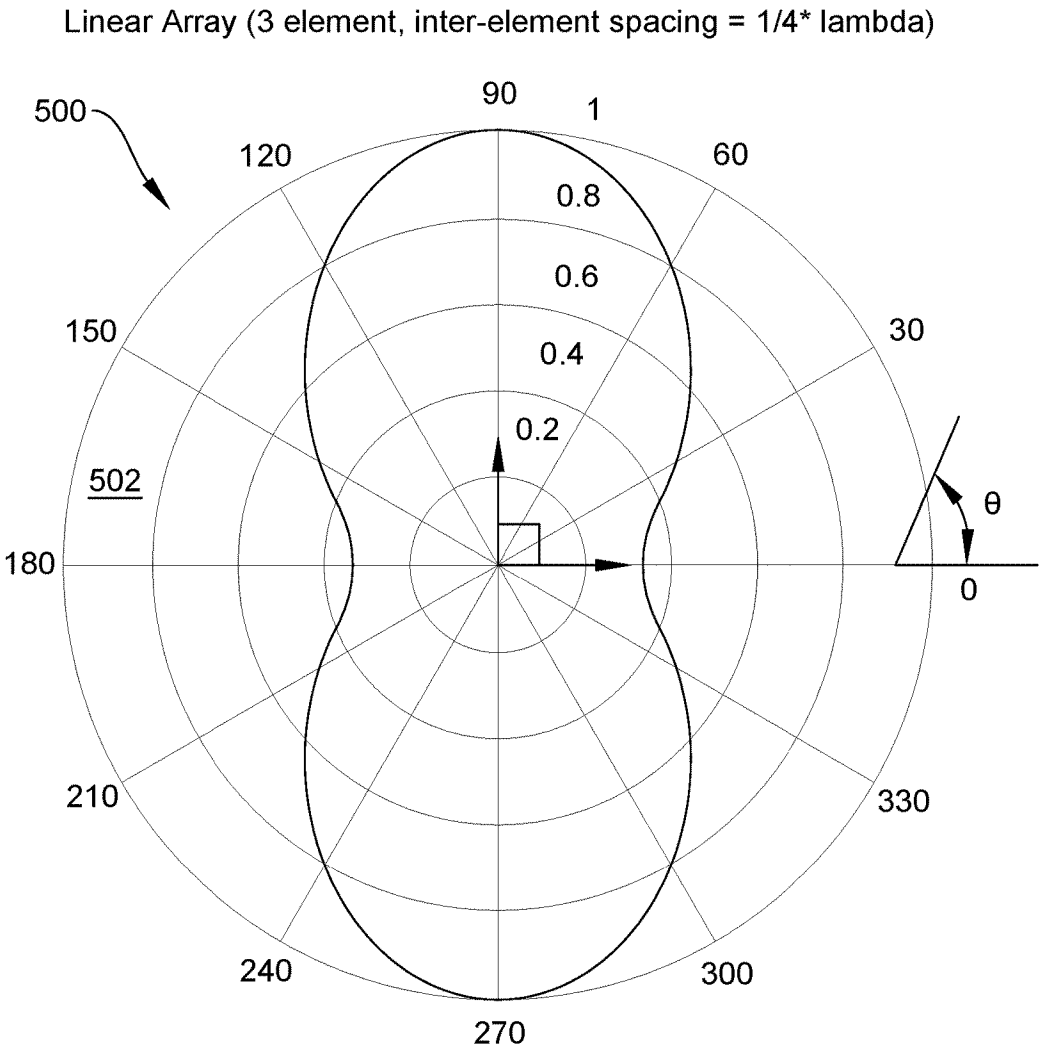
FIG. 5 illustrates a polar pattern for the linearly arranged microphone array in FIG. 4, showing the maximum of the signal reception for the array being happened along the broadside direction, in accordance with an embodiment of the present invention.
Figure 13:
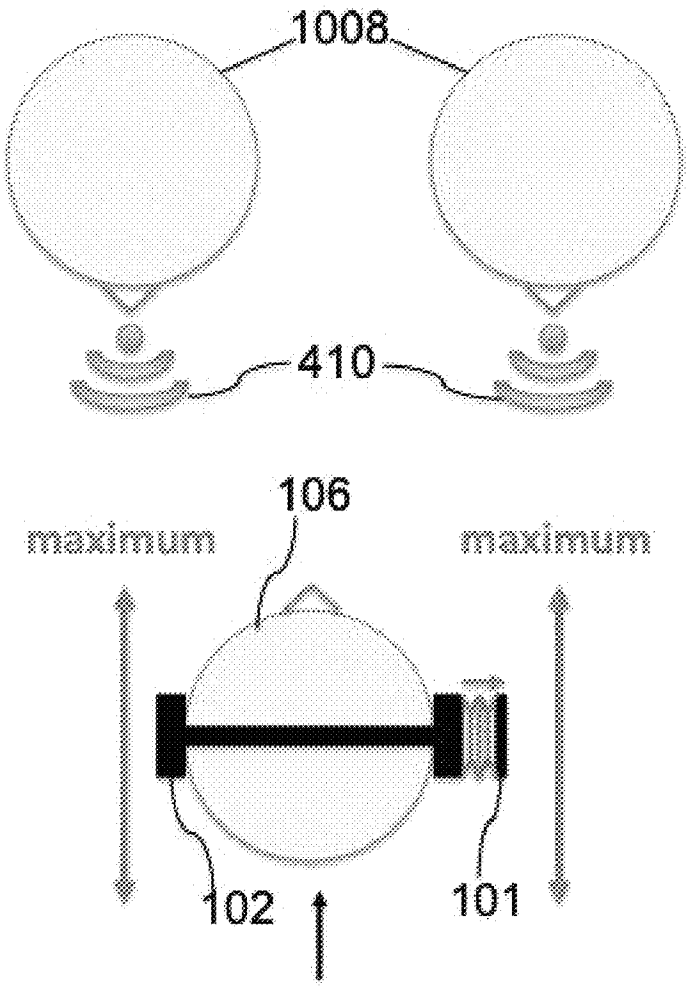
FIG. 13 illustrates the listener wearing two of the earpieces with one earpiece in a natural position, and an outer part of a second earpiece extended, to capture forward audio signals for the maximum sound reception, in accordance with an embodiment of the present invention.
Figure 15:
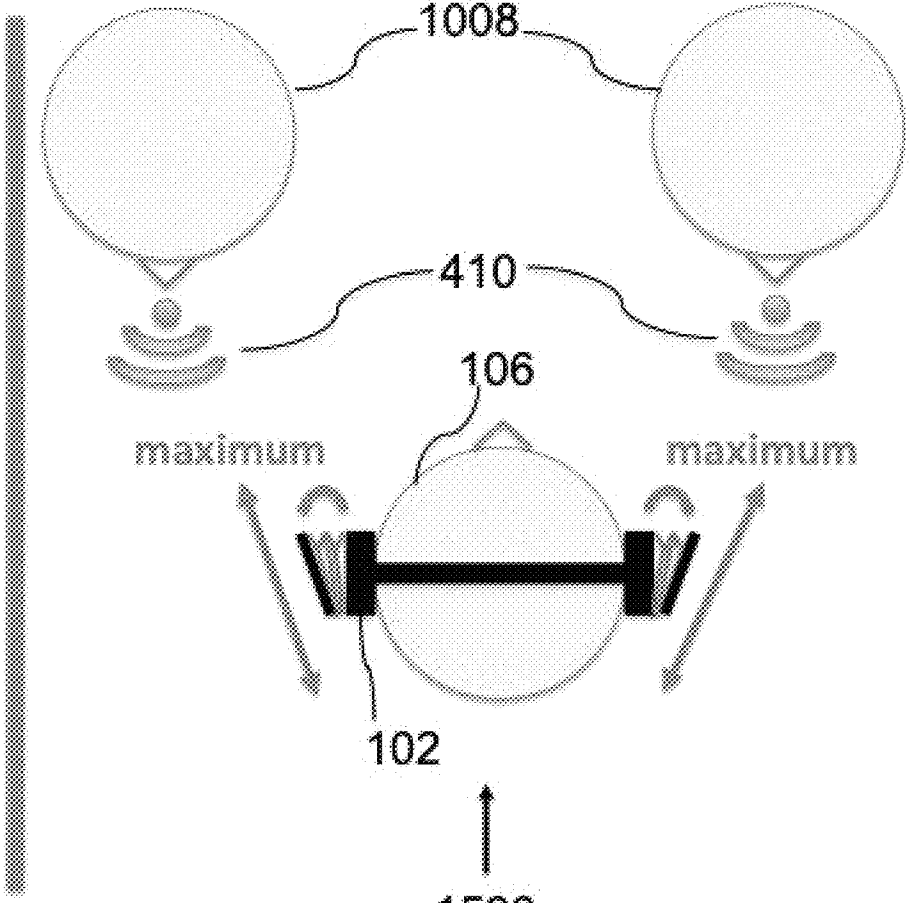
FIG. 15 illustrates the listener wearing two of the earpieces with both earpieces' outer parts pivoted along an elevation plane to capture forward audio signals for the maximum sound reception, in accordance with an embodiment of the present invention.
Figure 14:
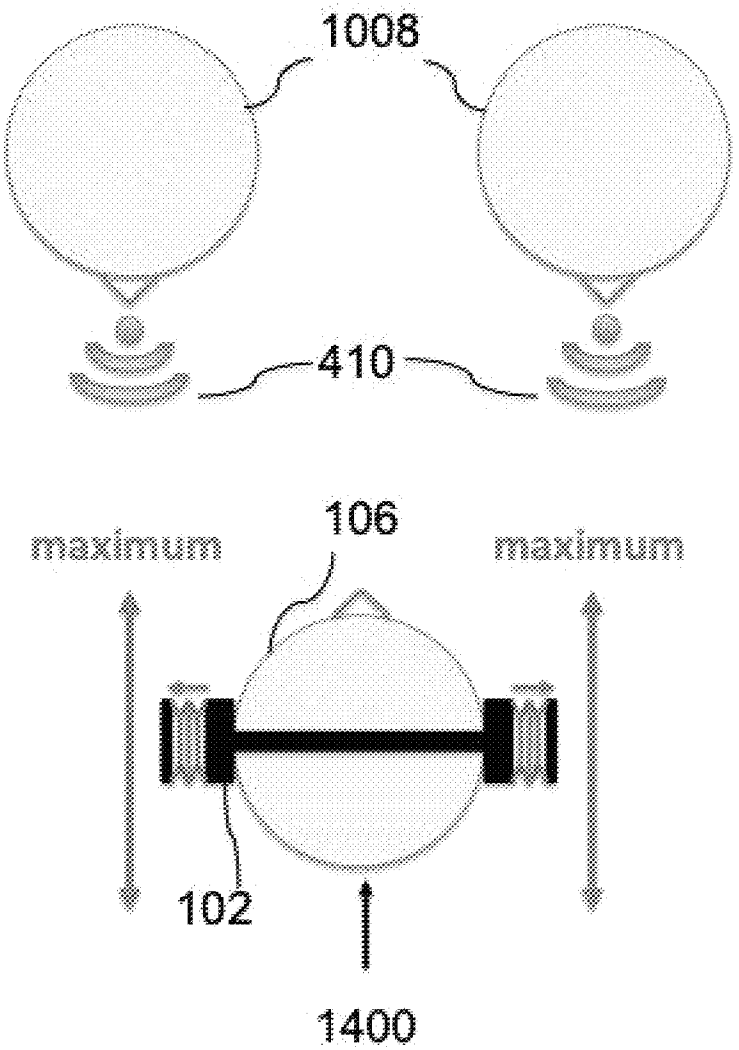
FIG. 14 illustrates the listener wearing two of the earpieces with their outer parts extended laterally to capture forward audio signals for the maximum sound reception, in accordance with an embodiment of the present invention.

In one embodiment, the microphone array 112 is laterally extendable and retractable to obtain optimal audio input signals 410 and to minimize noise interference (FIG. 13-14). In another embodiment, the microphone array 112 is pivotable along its elevational plane 802 to obtain an optimal audio signal 410 and to minimize noise interference (FIG. 15). FIG. 5 illustrates a polar pattern chart 500 with respect to an arriving angle θ, also known as Direction of Arrival (DOA), of an incoming signal 410 for the microphone array 112. A polar pattern of a microphone can be generally defined as a normalized receiving sensitivity for sound sources arriving from different angles [4]. FIG. 5 also shows the broadside direction 402 and the endfire direction 404 as a reference. The maximum, or optimal, sounds can be clearly concluded at θ=90° or 270°, which are along the broadside direction 402 on the chart 500 [5].

Figure 6:
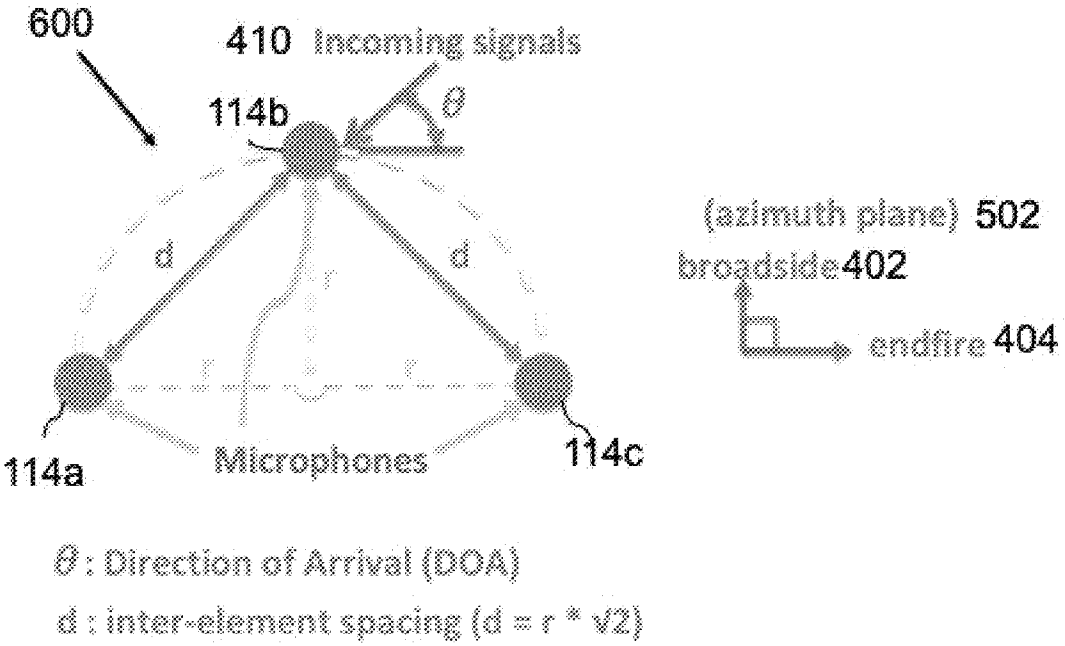
FIG. 6 illustrates microphones for a microphone array configured in a circular arrangement, showing the direction of the incoming audio signal, inter-element spacing, radius of the circle, and the broadside and endfire direction for the array, in accordance with an embodiment of the present invention.

FIG. 6 shows the microphones of the microphone array 112 configured in a circular arrangement with inter-element spacing $d=r*\sqrt{2}$, where r is the radius of the circle. The angles of the desired sound source which initiates the audio signal 410 arrive similar to the linear configuration, as described below. Nonetheless, the linear or circular arrangements 400, 600 are configured to improve desired signal reception or noise cancellation on the microphone design.

Figure 7:
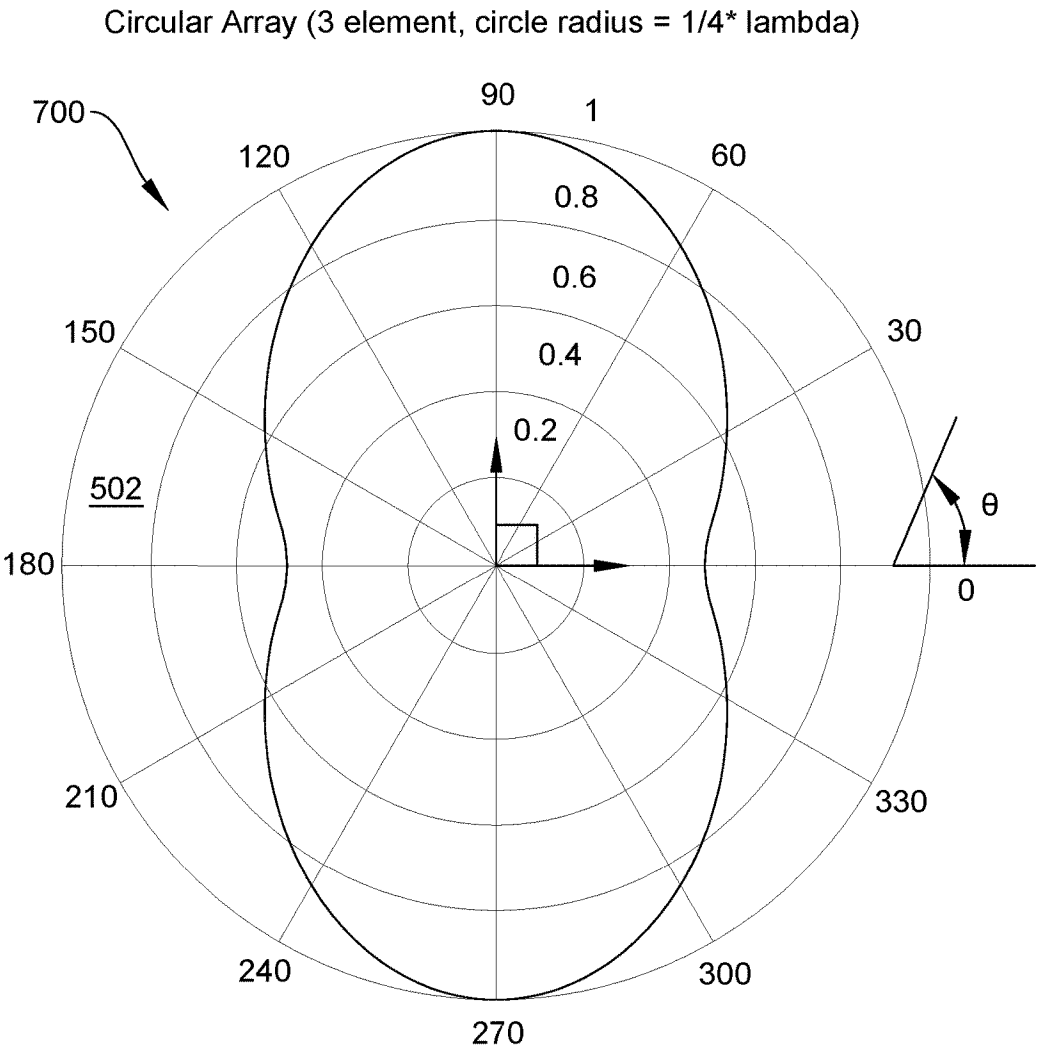
FIG. 7 illustrates a polar pattern for the circularly arranged microphone array in FIG. 6, showing the maximum of the signal reception for the array being happened along the broadside direction, in accordance with an embodiment of the present invention.

FIG. 7 illustrates a microphone polar pattern chart 700 of the microphone array 112 in the circular arrangement 600, the incoming audio signal with DOA angle θ, the broadside direction 402, the endfire direction 404. Similarly, the maximum sound receptions are located along broadside (θ=90° or 270°) with the circular arrangement. The microphone array 112 can also be adjusted on the earpiece 102 as described above to achieve the maximum sound reception through extending and pivoting the earpiece 102.

Figure 8:
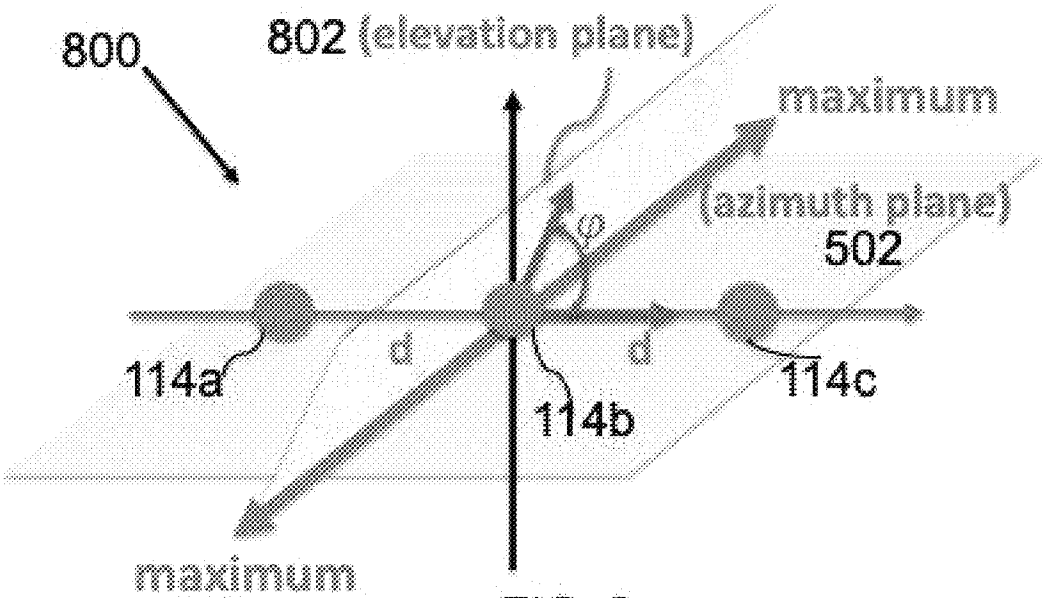
FIG. 8 illustrates a linearly arranged microphone array and its associated azimuth plane with the direction of the maximum signal reception, and an elevation angle $\varphi$ on an elevation plane, in accordance with an embodiment of the present invention.

FIG. 8 illustrates a configuration of a microphone array drawing 800 showing a linear array with three microphones 114*a-c* on the azimuth plane 502 and an elevation angle φ on an elevation plane 802. It has been shown above that the maximum on the azimuth plane 502 is located along the red line, the broadside direction.

Figure 9:
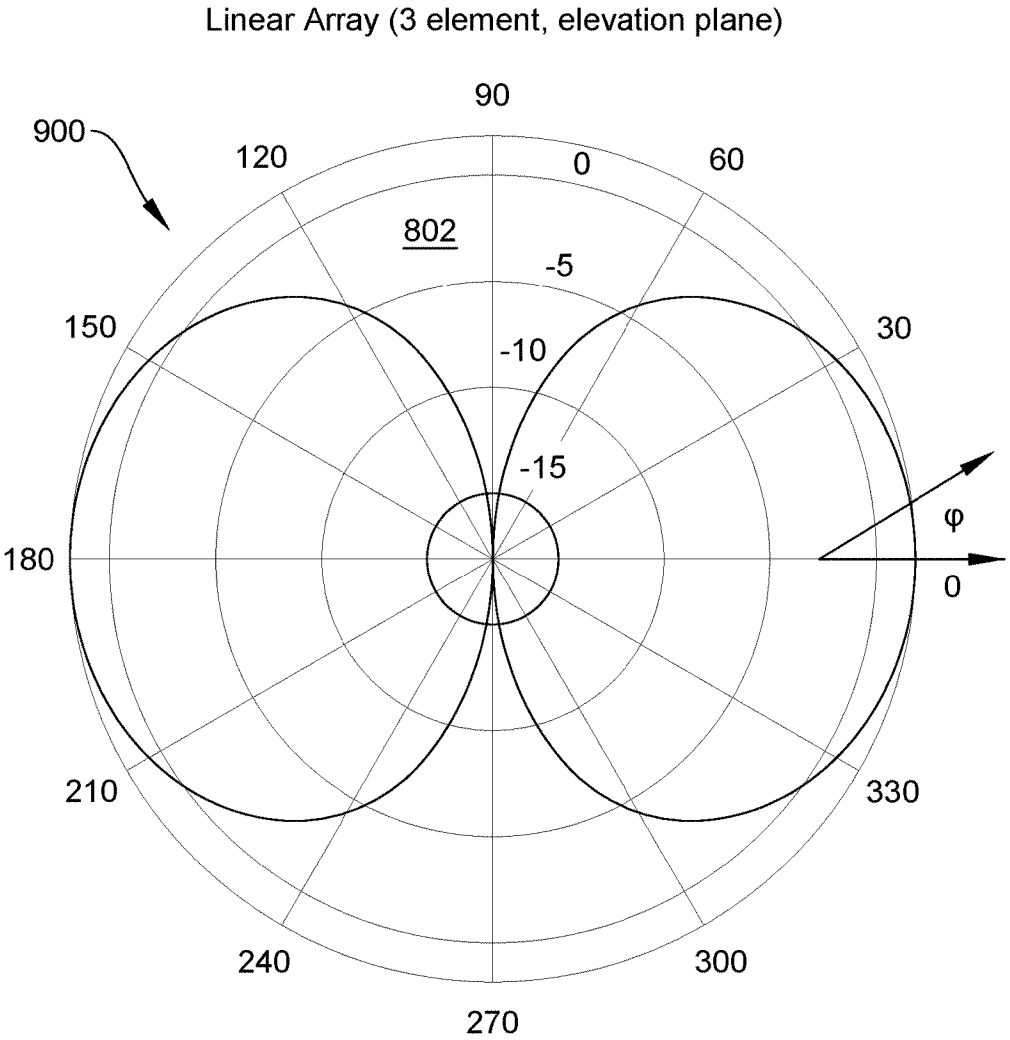
FIG. 9 illustrates a polar pattern for the linearly arranged microphone array in FIG. 8, showing the maximum of the signal reception for the array being happened on the azimuth plane, i.e. $\varphi=0°$, 180°, in accordance with an embodiment of the present invention.

FIG. 9 illustrates a polar pattern chart 900 with respect to an elevation angle φ, φ=0°~360°, on the elevation plane 802 for the linear microphone array 114*a-c*. In this arrangement, it is also straightforward from chart 900 that the maximum signal reception located at φ=0°, 180°, which is on the azimuth plane 502. Without losing the generality, it can then be concluded that if the earpiece 102 is both rotated along the azimuth plane 502 and pivoted along the elevation plane 802, the maximum, or optimal, sound reception happens along the broadside direction of the microphone array regardless of its configuration.

Figure 10:
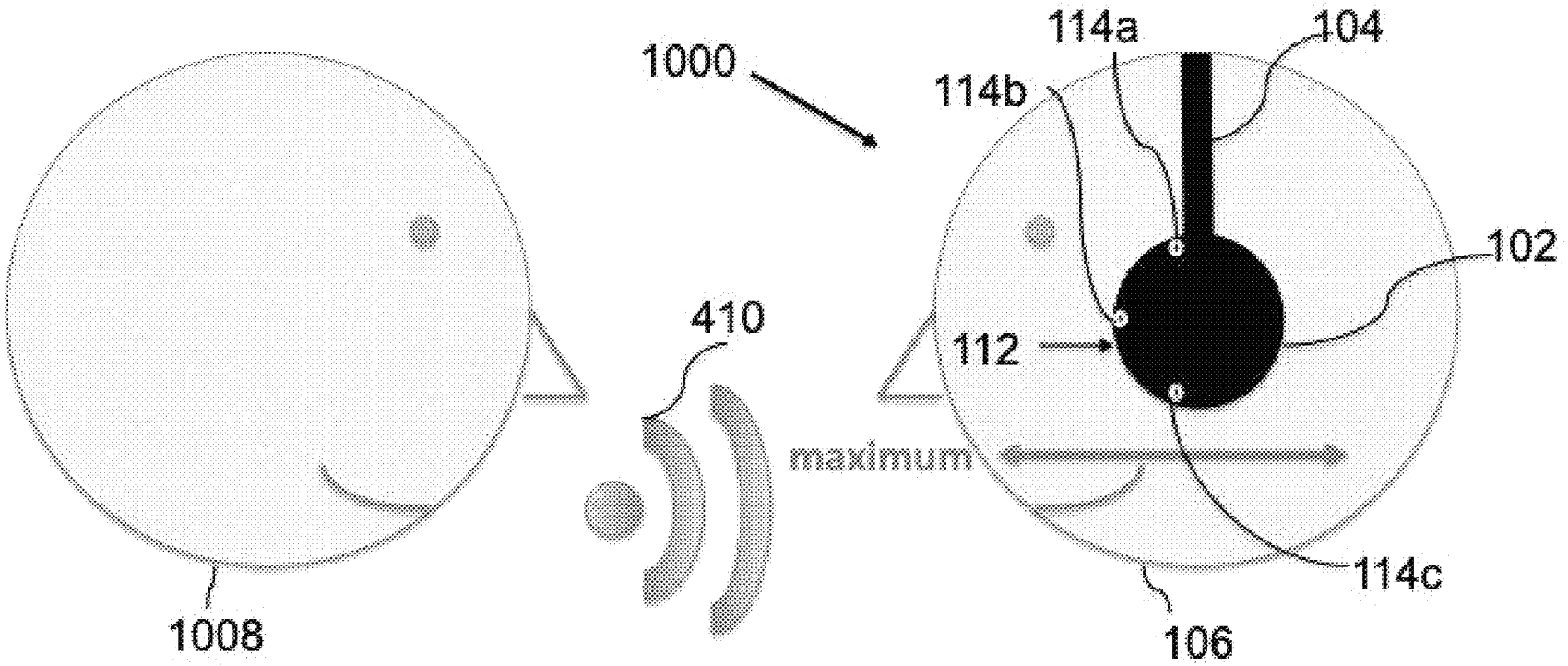
FIG. 10 illustrates a diagram showing a sound source emitting an audio signal at an optimal straight angle towards an exemplary earpiece, in accordance with an embodiment of the present invention.

Referring to FIGS. 10-17, while at least one of the earpiece 102 is worn, the listener can adjust the microphone array 112 on the outer part 101 of the earpiece 102 to achieve the optimal setting described in the charts above. FIG. 10 illustrates a diagram showing a desired sound source 1008 emitting an audio signal 410 at an optimal straight angle towards the listener 106 wearing the earpiece 102. As shown in FIG. 11, the desired sound source 1008 moves from a broadside direction 402, which is generally straightforward of the listener 106, to another position along an azimuth plane of the microphone array 112. The outer part of the earpiece 102 adjustably rotates so that the microphone array 112 can be oriented on its azimuth plane for the maximum reception of sound source 1008 and minimum interference.

Thus, controlled by the listener 106, the outer part 101 of the earpiece 102 may be manually or automatically rotated, pivoted, extended, or retracted along the azimuth plane 502 and/or the elevational plane 802 to optimize sound reception for the microphone array 112. For example, FIG. 12 illustrates the listener wearing two of the earpieces 102 with both earpieces in a natural position 1200 to capture forward audio signals 410 from the sound sources 1008 for the maximum sound reception.

Continuing, FIG. 13 illustrates the listener 106 wearing two of the earpieces 102 with one earpiece in a natural position, and the outer part 101 of another earpiece laterally extended 1300, to capture forward audio signals 410 from the sound sources 1008 for the maximum sound reception. FIG. 14 illustrates the listener 106 wearing two of the earpieces 102 with the outer parts of both earpieces extended laterally 1400 to capture forward audio signals 410 from the sound sources 1008 for the maximum sound reception.

In additional embodiments of possible manipulations by the earpiece 102, FIG. 15 illustrates the listener wearing two of the earpiece 102 with the outer part of both earpieces pivoted outwardly 1500 along the elevation plane, so as to capture forward audio signals 410 from the sound sources 1008 for the maximum sound reception.

Figure 16:
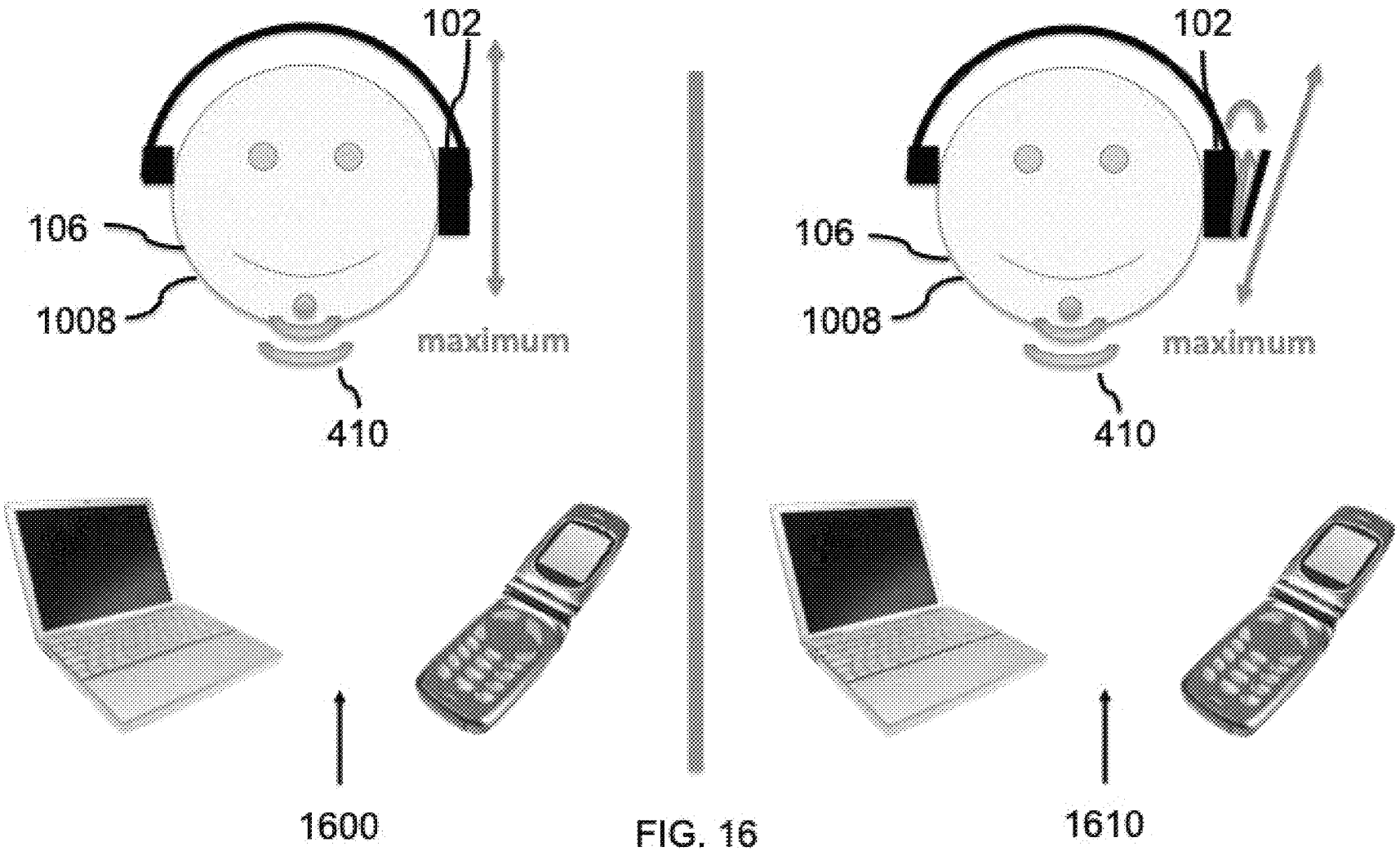
FIG. 16 illustrates a headset user in conversation wearing an earpiece with its outer part pivoted along an elevation place to capture forward audio signals for the maximum sound reception, in accordance with an embodiment of the present invention.

While the audio signals 410 coming from other people, FIG. 16 illustrates a headset usage scenario 1600, where the sound source 1008 can also be the listener 106. The listener 106, also the sound source 1008, wears an earpiece 102 with its outer part pivoted outwardly 1610 along the elevation plane to capture audio input signals 410 for the maximum sound reception.

Figure 17:
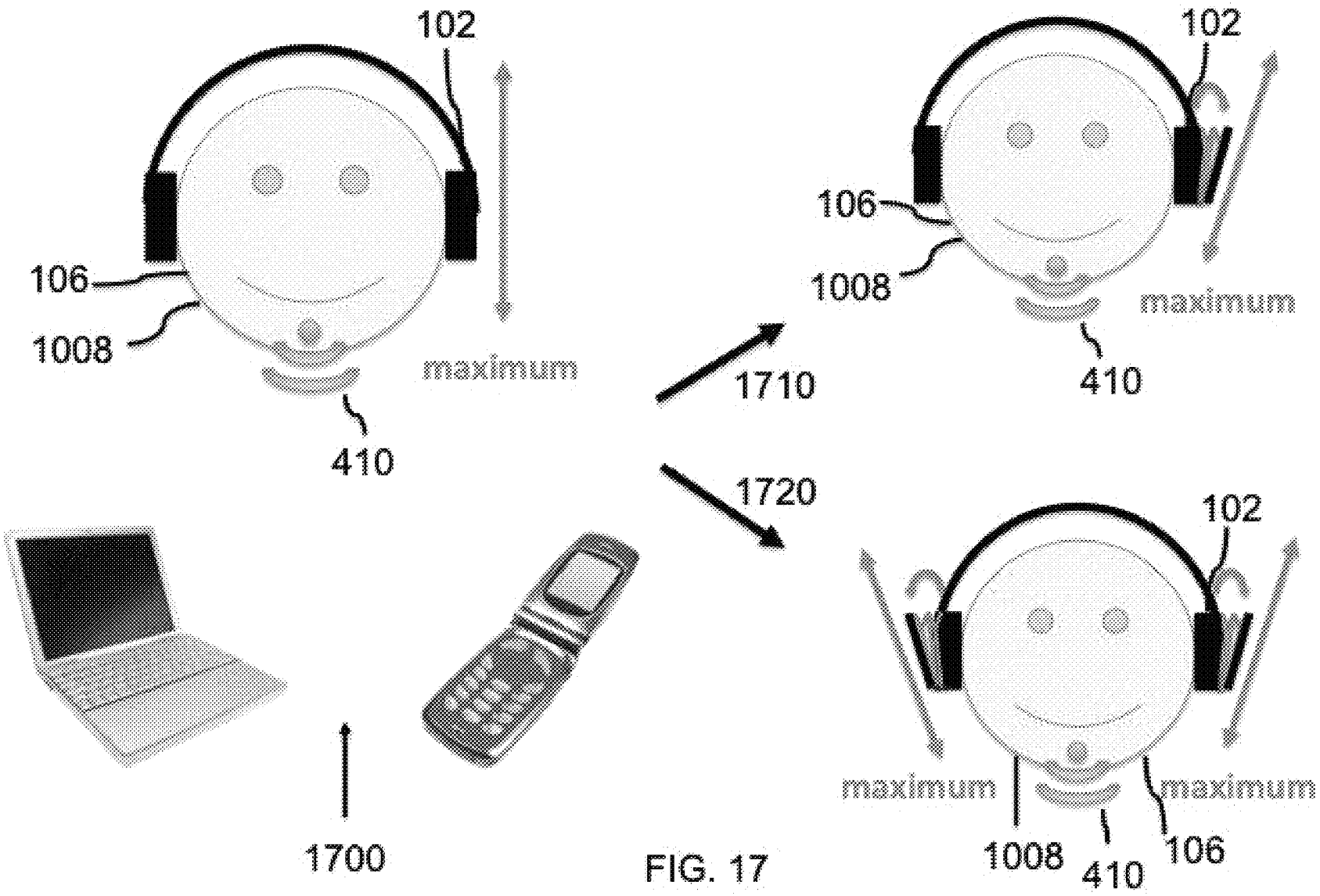
FIG. 17 illustrates a headset user in conversation wearing two of the earpieces with either one or two earpieces' outer parts pivoted along an elevation place to capture forward audio signals for the maximum sound reception, in accordance with an embodiment of the present invention.

FIG. 17 illustrates another usage scenario 1700 where the listener 106 wears two of the earpieces 112 as a headset during conversations which may generate the sound source 1008. The outer parts of both earpieces can be pivoted either one 1710 or both 1720 outwardly along the elevation plane to capture audio input signals 410 for the maximum sound reception.

In some applications, such as hearing aids, the speakers may be placed near the microphones. For those embodiments, those configurations may cause acoustic feedback due to the leak acoustic paths to the close microphones from the speakers with the high power audio output signals. The feedback reduction or cancellation function can, therefore, be included in the earpiece 102. Also, while rotating microphones in previous embodiments can reduce ambient noise, a noise reduction, a wind noise reduction, and/or speech enhancement functions can be added into the earpiece 102 to further improve the desired signal quality during conversations.

In any of these earpiece arrangements 300, 1000, 1100 1200, 1300, 1400, 1500, 1600, and 1700 manipulation of the earpiece 102 enables: 1) easy to adjust for the phase combinations of the sound coming out of the speakers; and 2) directional movement of the microphone array 112 to point the reception pattern's maximum of the microphones to the direction of the listener's desired sound source 1008, so as to obtain better signal receptions with less noise interference.

Figure 18:
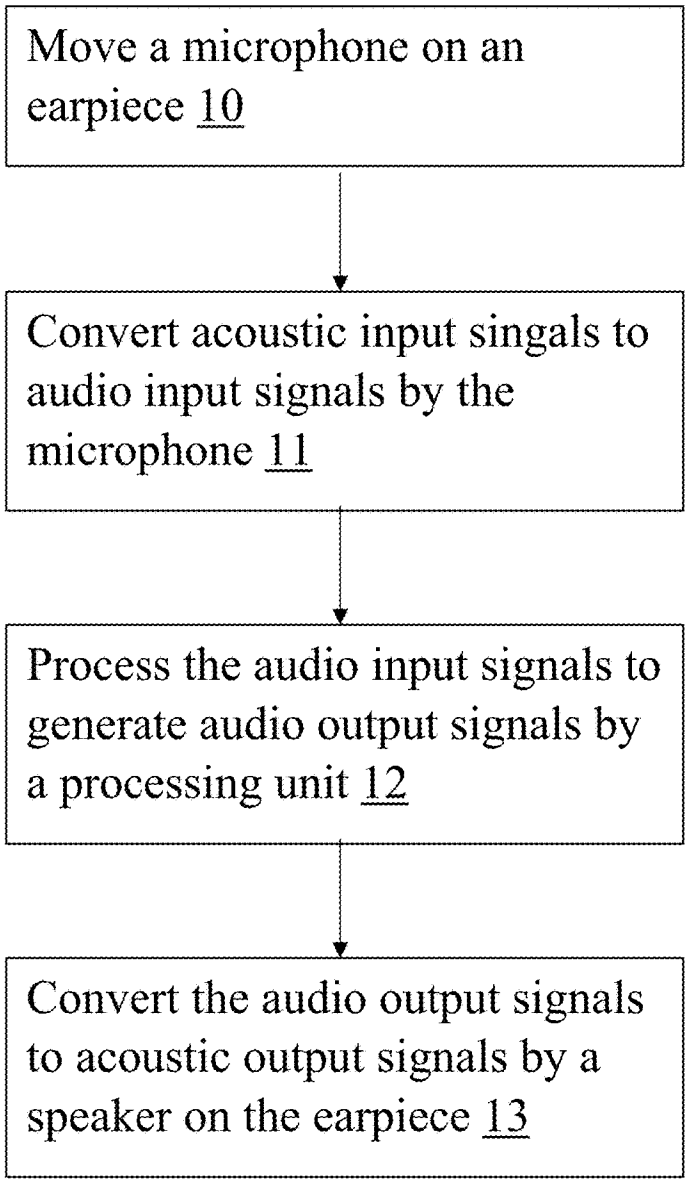
FIG. 18 is a block diagram of a method for operating the wearable sound system in accordance with the above-mentioned embodiment of the present invention.

Referring to FIG. 18 of the drawings, a method for operating a wearable sound system, comprises:

Move a microphone on an earpiece (10);

Convert acoustic input signals to audio input signals by the microphone on the earpiece (11);

Process the audio input signals to generate audio output signals by a processing unit (12); and Convert the audio output signals to acoustic output signals by a speaker on the earpiece (13).

In one embodiment, at least one of the microphones 114*a-c* is rotatably arranged on the earpiece, wherein the microphone can be rotatably arranged on the earpiece in a linear array or in a circular array.

In another embodiment, at least one of the microphones 114*a-c* is pivotably arranged on the earpiece.

In one aspect, at least one of the microphones 114*a-c* can be rotatably or pivotably arranged on the earpiece, wherein each of the microphones 114*a-c* can be individually rotated or pivoted with respect to the other microphones 114*a-c*.

In yet another embodiment, at least one of the microphones 114*a-c* is laterally extended and retracted towards the directions of the acoustic input signals.

In one aspect, at least one of the microphones 114*a-c* can be arranged on the earpiece, and at least one of the microphones 114*a-c* can laterally extend and retract towards the directions of the acoustic input signals.

Accordingly, in the azimuth of the microphone, the acoustic input signals are transmitted to the microphone to form an angle of θ, called Direction of Arrival (DOA). In one aspect, the maximum sound reception is located at the angle of "θ," which is 90 degrees.

Accordingly, in the elevation of the microphone, the acoustic input signals are transmitted to the microphone to form an angle of "φ," wherein the maximum sound reception is located at the angle of "φ" which is zero degrees.

Accordingly, the microphone can be rotated and moved on the earpiece to achieve better noise suppression and have a better quality of the desired acoustic input signals, wherein the listener can adjust the final positions of the microphone by hands, so as to consume less power and further prolong the battery life of the earpieces.

In still yet another embodiment, the method further comprises a step of:

Rotate at least one of the speakers 300*a-e* on the earpiece, wherein the speaker is operable to generate a range of sound frequencies.

In one aspect, at least one of the speakers 300*a-e* can be rotatably arranged on the earpiece.

Accordingly, each of the speakers 300*a-e* can be individually rotated for a listener's preference.

In one aspect, the speakers 300*a-e* can be selectively rotated clockwise or counter-clockwise, wherein the earpiece may have at least one speaker 300*a-e*. In other words, each of the speakers 300*a-e* can individually rotate by either clockwise or counter-clockwise direction.

In another aspect, at least one of the speakers 300*a-e* can rotate a predetermined angle clockwise or counter-clockwise, wherein the predetermined angle is selected from a group consisted of 30 degrees, 45 degrees, 60 degrees, and 90 degrees. Therefore, the combinations of the rotation method of the speakers 300*a-e* can generate the preferred sound effects for the listener.

Accordingly, for example, one of the speakers 300*a-e* can rotate clockwise, and the other one of the speakers 300*a-e* can rotate counter-clockwise. In another example, one of the speakers 300*a-e* may rotate clockwise, and the other one of the speakers 300*a-e* may rotate clockwise. In yet another example, one of the speakers 300*a-e* may rotate counter-clockwise, and another one of the speakers 300*a-e* may rotate counter-clockwise.

In still yet another aspect, each of the positions of the speakers 300*a-e* is determined by audio output characteristics, wherein the audio output characteristics can be audio output volumes or frequencies, and the audio output characteristics are generated based on either a listener's subjective preference or objective preference, such as hearing characteristics, ear canal acoustic characteristics, or preferred spectral enhancement for some frequencies.

Figure 19:
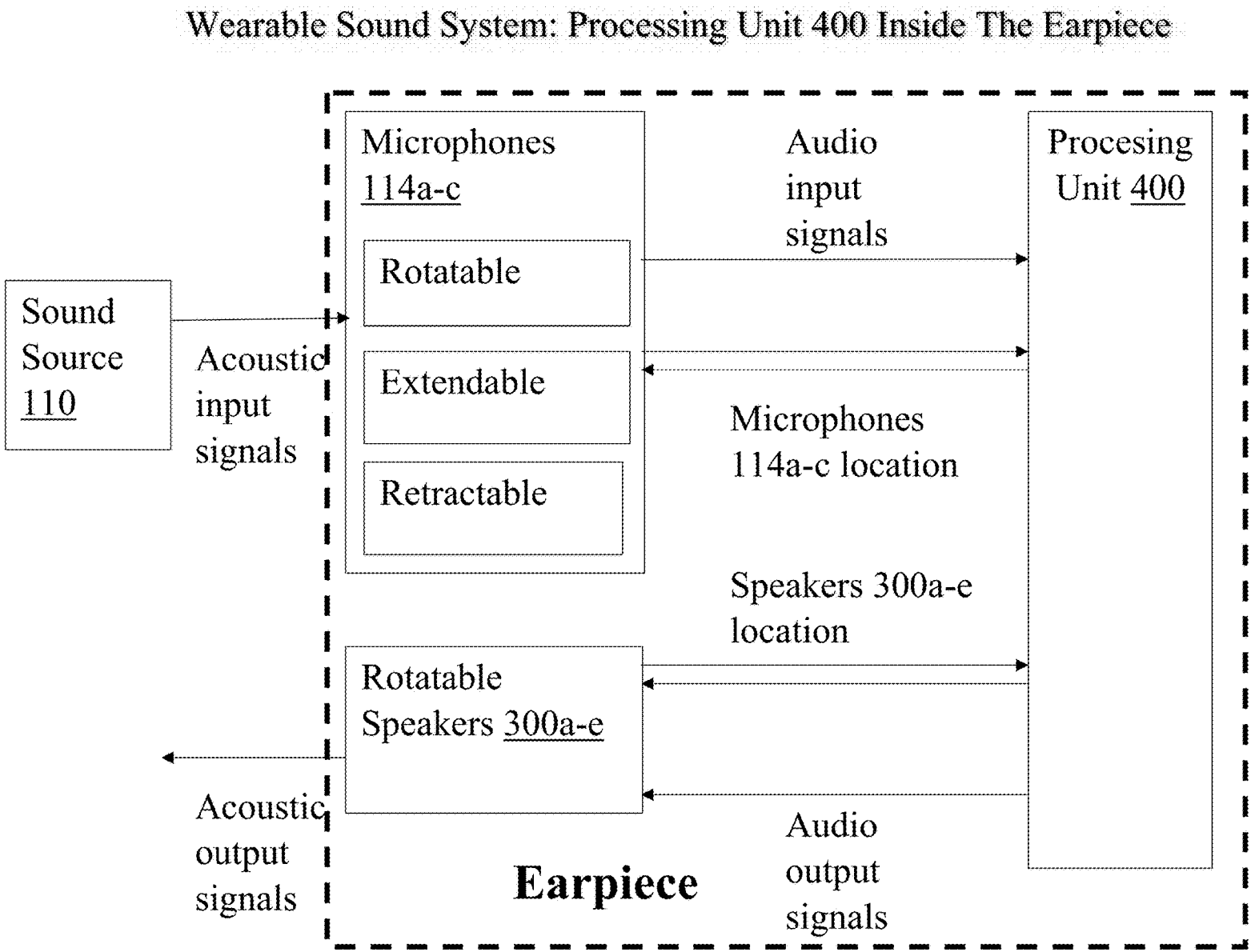
FIG. 19 is a block diagram of a system for operating the wearable sound system with a processing unit integrated inside the earpiece, in accordance with the above-mentioned embodiment of the present invention.
Figure 20:
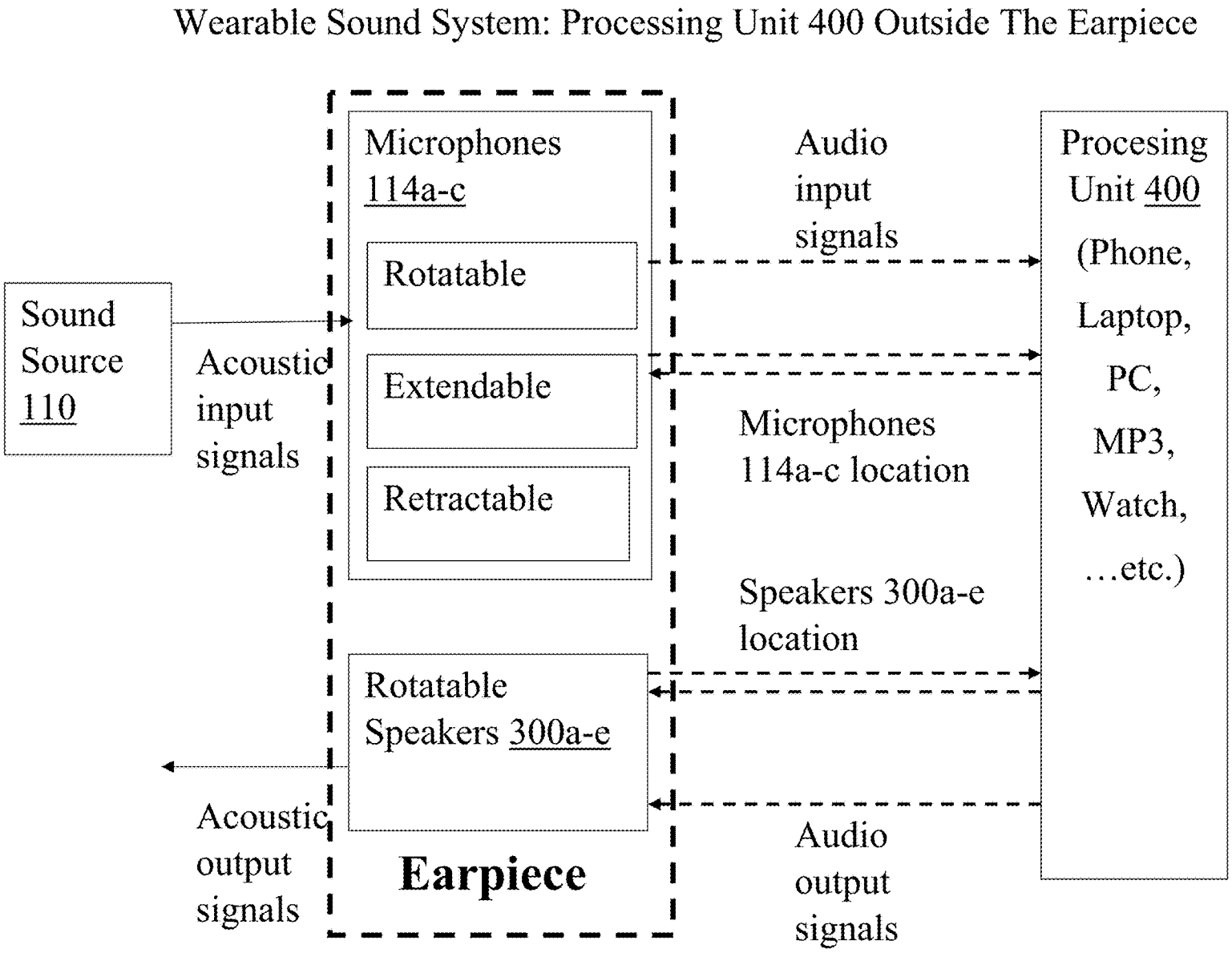
FIG. 20 is a block diagram of a system for operating the wearable sound system with a processing unit outside the earpiece, in accordance with the above-mentioned embodiment of the present invention.

In yet another embodiment, the method further comprises another step of:

Detect the best stopping position for the speakers 300*a-e* by a processing unit 400, wherein the processing unit 400 can be integrated into the earpiece, as shown in FIG. 19, or in another electronic device connected the earpiece with wire or wireless link, as shown in FIG. 20.

In one aspect, the processing unit 400 is configured to receive the listener's subjective preferences or the objective preferences, and then determine whether audio output characteristics can achieve the listener's subjective preferences or the objective preferences while the speakers are in the best stopping position.

In another aspect, the best stopping position may be customized by the listener. Therefore, the listener may selectively adjust the positions of the speakers until the speakers are in the desired position. In other words, the listener can selectively adjust the positions of the speakers by hands or other controllers.

In yet another aspect, the speakers can be configured to generate surround sound. Sources of surround sound can either come from pre-recorded sources, such as a movie or a video clip, or from the microphones 114*a-c* for live surround listening. Inputs from the array of microphones 114*a-c* can recreate the live surround sound environment by playing sound from each individual microphone. Then the listener can choose to tune up or down in volume for each microphone's audio input signals. This can help hearing-impaired people listening to desired sound sources easier in a live noisy environment like restaurants or concerts.

FIG. 19-20 generally depicts a wearable sound system in accordance with one of the disclosed embodiments.

The wearable sound system comprises at least one of the movable microphones 114*a-c* on an earpiece to convert sound from acoustic input signals to audio input signals, a processing unit 400 electrically connected with at least one of the movable microphones, and at least one of the speakers 300*a-e* electrically connected with the processing unit 400.

In another embodiment, at least one of the microphones 114*a-c* can be rotatably or pivotably arranged on the earpiece, and at least one of the speakers 300*a-e* can be rotatably arranged on the earpiece.

In one aspect, the audio input signals 410 are generated from a sound source, wherein the audio input signals may be processed to generate audio output signals through the processing unit 400, and then the audio output signals may be further converted to acoustic output signals through the speakers 300*a-e*.

In another aspect, at least one of the movable microphones 114*a-c* on the earpiece is extended and retracted laterally. Accordingly, at least one of the microphones can laterally extend and retract on the earpiece.

In yet another aspect, the audio input signals are sent to the processing unit 400 in a real-time or pre-recorded way based on the listener's preference.

In still yet another aspect, at least one of the speakers 300*a-e* may be rotatably arranged on the earpiece to generate a range of sound frequencies, wherein the speakers 300*a-e* may rotate clockwise or counter-clockwise. In addition, the speakers 300*a-e* may be arranged on the earpiece, wherein each of the speakers 300*a-e* can individually rotate clockwise or counter-clockwise.

In another embodiment, the earpiece may selectively comprise a size-adjustable headband or an ear-hook mechanism. Therefore, the earpiece can be snugly hanged on the listener's head or ears. In addition, the earpiece can be wirelessly connected to remote devices, wherein the motions of the speakers 300*a-e* and the microphones 114*a-c* can be controlled by the remote devices.

In another embodiment, the functions for the reduction of feedback, noise, and/or wind noise can be processed by the processing unit 400.

These and other advantages of the invention will be further understood and appreciated by those skilled in the art by reference to the following written specification, claims, and appended drawings.

Because many modifications, variations, and changes in detail can be made to the described preferred embodiments of the invention, it is intended that all matters in the foregoing description and shown in the accompanying drawings be interpreted as illustrative and not in a limiting sense.

Thus, the scope of the invention should be determined by the appended claims and their legal equivalence.

REFERENCES

[1] M. HiiPakka, "Measurement Apparatus and Modeling Techniques for Ear Canal Acoustics", Master Thesis, 2008

[2] Lipshitz et. al, "On the Audibility of Midrange Phase Distortion in Audio Systems" *J. Audio Eng. Soc.*, Vol. 30, No, 9, September 1982

[3] Henry L. Van Trees, "Optimum Array Processing", 2002

[4] https://www.shure.eu/musicians/discover/educational/polar-patterns

[5] J. Kraus, R. Marhefka, "Antennas", 2003

What is claimed is:

1. A wearable sound system, comprising:

at least one microphone array, comprising at least one microphone, located on or near at edge of a movable outer part of an earpiece to convert sound from acoustic input signals to audio input signals;

a processing unit to process the audio input signals to generate audio output signals; and at least one speaker array, comprising at least one speaker, located on or near at edge of a movable inner part of the earpiece to convert the audio output signals to acoustic output signals, wherein the movable inner part and the movable outer part are located on opposite sides of the earpiece;

wherein, ambient sounds collected by the microphone array is directly output by the speaker array after being adjusted by the processing unit.

2. The system, as recited in claim 1, wherein the movable outer part of the earpiece with the microphone is rotatable on an azimuth plane of the microphone to obtain an optimal audio input signal, and to minimize ambient noise and interference.

3. The system, as recited in claim 1, wherein the movable outer part of the earpiece with the microphone is pivotable along an elevation plane of the microphone to obtain an optimal audio input signal, and to minimize ambient noise and interference.

4. The system, as recited in claim 1, wherein the movable outer part of the earpiece with the microphone can be laterally extended and retracted along the direction perpendicular to the azimuth plane of the microphone to obtain an optimal audio input signal, and to minimize ambient noise and interference.

5. The system, as recited in claim 1, wherein the processing unit processes the audio input signals in a real-time or pre-recorded way according to a listener's preference.

6. The system, as recited in claim 1, wherein the movable inner part being arranged in a rotatable configuration and the speaker array is operable to generate a range of sound frequencies, and when there are multiple microphone arrays, the microphone arrays are arranged with a spatially interval apart from one another.

7. The system, as recited in claim 6, wherein the movable inner part is rotated clockwise or counter-clockwise.

8. The system, as recited in claim 6, wherein positions and the audio output signals of the speaker are determined by the processing unit according to a listener's preference.

9. The system, as recited in claim 1, wherein the speaker array is operable to generate surround sound.

10. The system, as recited in claim 1, wherein the earpiece comprises a size-adjustable headband.

11. The system, as recited in claim 1, wherein the earpiece comprises an ear-hook mechanism.

12. The system, as recited in claim 1, wherein the earpiece is wireless.

13. A method for operating a wearable sound system, comprising:

moving at least one microphone array, comprising at least one microphone, located on or near at edge of movable outer part of an earpiece;

converting acoustic input signals to audio input signals by the microphone array on the earpiece;

processing the audio input signals to generate audio output signals by a processing unit;

converting the audio output signals to acoustic output signals by at least one speaker array, comprising at least one speaker, located on a movable inner part of the earpiece, wherein the movable inner part and the movable outer part are located on opposite sides of the earpiece;

wherein, ambient sounds collected by the microphone array is directly output by the speaker array after being adjusted by the processing unit.

14. The method, as recited in claim 13, wherein the outer part of the earpiece with the microphone is moved in a rotatable configuration to obtain an optimal audio input signal, and to minimize ambient noise and interference.

15. The method, as recited in claim 13, wherein the outer part of the earpiece with the microphone is moved in a pivotable configuration to obtain an optimal audio input signal, and to minimize ambient noise and interference.

16. The method, as recited in claim 13, wherein the outer part of the earpiece with the microphone is moved in lateral extension and retraction to obtain an optimal audio input signal, and to minimize ambient noise and interference.

17. The method, as recited in claim 13, further comprising rotating the movable inner part on the earpiece, wherein the speaker being operable to generate a range of sound frequencies.

18. The method, as recited in claim 17, wherein the movable inner part on the earpiece is rotated clockwise or counter-clockwise.

19. The method, as recited in claim 17, wherein positions and audio out signals of the speaker are determined by the processing unit based on the listener's preference.

20. The method, as recited in claim 13, wherein the speaker array is operable to generate surround sound.

* * * * *